US010692638B2

(12) United States Patent
Cho et al.

(10) Patent No.: US 10,692,638 B2
(45) Date of Patent: Jun. 23, 2020

(54) MAGNETIC SHEET AND ELECTRONIC DEVICE

(71) Applicant: SAMSUNG ELECTRO-MECHANICS CO., LTD., Suwon-si (KR)

(72) Inventors: Jung Young Cho, Suwon-si (KR); Tai Yon Cho, Suwon-si (KR); Sung Nam Cho, Suwon-si (KR); Chang Hak Choi, Suwon-si (KR); San Kyeong, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 306 days.

(21) Appl. No.: 15/720,463

(22) Filed: Sep. 29, 2017

(65) Prior Publication Data

US 2018/0240582 A1 Aug. 23, 2018

(30) Foreign Application Priority Data

Feb. 21, 2017 (KR) ..... 10-2017-0023058

(51) Int. Cl.

| | |
|---|---|
| ***H01F 10/30*** | (2006.01) |
| ***H01F 1/153*** | (2006.01) |
| ***H01F 1/40*** | (2006.01) |
| ***H01F 1/01*** | (2006.01) |
| *H01F 27/36* | (2006.01) |
| *H01F 38/14* | (2006.01) |

(52) U.S. Cl.

CPC ..... *H01F 10/30* (2013.01); *H01F 1/01* (2013.01); *H01F 1/15308* (2013.01); *H01F 1/15358* (2013.01); *H01F 1/40* (2013.01); *H01F 1/15333* (2013.01); *H01F 27/365* (2013.01); *H01F 38/14* (2013.01)

(58) Field of Classification Search

None

See application file for complete search history.

(56) References Cited

U.S. PATENT DOCUMENTS

| | | | | |
|---|---|---|---|---|
| 9,832,917 | B2 * | 11/2017 | Jang | H01F 1/16 |
| 10,123,467 | B2 * | 11/2018 | Lee | H01F 38/14 |
| 10,297,380 | B2 * | 5/2019 | Kim | H01F 38/14 |
| 2012/0062435 | A1 * | 3/2012 | Kato | H01Q 7/06 343/787 |
| 2014/0017486 | A1 * | 1/2014 | Yoo | B29C 67/0011 428/325 |
| 2014/0049212 | A1 * | 2/2014 | Sawa | H01F 38/14 320/108 |
| 2014/0145807 | A1 * | 5/2014 | Choi | H01F 27/365 335/302 |
| 2014/0239892 | A1 * | 8/2014 | Sawa | H01F 38/14 320/108 |

(Continued)

FOREIGN PATENT DOCUMENTS

| | | |
|---|---|---|
| JP | 2007-123575 A | 5/2007 |
| JP | 2009-239131 A | 10/2009 |

OTHER PUBLICATIONS

Machine Translation of JP 2009-239131 A. (Year: 2009).*

*Primary Examiner* — Kevin M Bernatz

(74) *Attorney, Agent, or Firm* — NSIP Law

(57) ABSTRACT

A magnetic sheet includes one or more magnetic layers formed of a metal ribbon, the metal ribbon includes fragments with metal oxide coating layers formed in spaces between the fragments.

21 Claims, 4 Drawing Sheets

(56) References Cited

U.S. PATENT DOCUMENTS

| | | | | |
|---|---|---|---|---|
| 2015/0123604 | A1* | 5/2015 | Lee | B32B 37/12 320/108 |
| 2015/0334886 | A1* | 11/2015 | Jang | B32B 7/06 428/201 |
| 2016/0055952 | A1* | 2/2016 | Watanabe | H01F 1/16 33/361 |
| 2017/0140864 | A1* | 5/2017 | Arai | H01F 1/28 |
| 2017/0209924 | A1* | 7/2017 | Suetsuna | B22F 1/0055 |
| 2018/0352688 | A1* | 12/2018 | Jang | H01F 38/14 |
| 2018/0359885 | A1* | 12/2018 | Woo | H01F 27/365 |
| 2018/0366834 | A1* | 12/2018 | Graff | H01F 1/24 |
| 2018/0375210 | A1* | 12/2018 | Graff | H01P 1/365 |

* cited by examiner

MAGNETIC SHEET AND ELECTRONIC DEVICE

CROSS-REFERENCE TO RELATED APPLICATION(S)

This application claims the benefit under 35 USC § 119(a) of Korean Patent Application No. 10-2017-0023058 filed on Feb. 21, 2017 in the Korean Intellectual Property Office, the entire disclosure of which is incorporated herein by reference for all purposes.

BACKGROUND

1. Field

The present disclosure relates to a magnetic sheet and an electronic device.

2. Description of Related Art

Functions, such as a Wireless Power Consortium (WPC) standard function, a Near Field Communication (NFC) function, and a Magnetic Secure Transmission (MST) function have increasingly been used in portable mobile apparatuses. WPC technology, NFC technology, and MST technology have differences, such as, different operating frequencies, different data transmission rates, and different power transmission amounts.

In a wireless power transmitting apparatus, a magnetic sheet that blocks and collects electromagnetic waves is used. For example, in a wireless charging apparatus, the magnetic sheet is disposed between a reception coil and a battery. The magnetic sheet blocks a magnetic field generated in the reception coil from arriving at the battery and efficiently transmits electromagnetic waves generated by the wireless power transmitting apparatus to a wireless power receiving apparatus.

A magnetic induction scheme is used in a wireless power transmission field, and WPC and Power Matters Alliance (PMA) standards have used a frequency band of 100 kHz to 357 kHz. A magnetic shielding sheet used in the two wireless charging schemes is also designed to correspond to a frequency region of several hundreds of kHz. Due to an increase in a demand for a degree of charging freedom and simultaneous charging of a number of wireless chargers, in the future wireless power transmission field, it is expected that an Alliance for Wireless Power (A4WP) standard using a magnetic resonance scheme and a frequency of about 6.78 MHz will be introduced and a magnetic sheet corresponding to such a standard will be needed.

However, a soft magnetic metal ribbon widely used in a portable wireless charging apparatus has high Bs and is advantageous in terms of thinness, but characteristics of the soft magnetic metal ribbon deteriorate in a band of several MHz.

SUMMARY

This Summary is provided to introduce a selection of concepts in a simplified form that are further described below in the Detailed Description. This Summary is not intended to identify key features or essential features of the claimed subject matter, nor is this Summary intended to be used as an aid in determining the scope of the claimed subject.

In one general aspect, there is provided a magnetic sheet including one or more magnetic layers formed of a metal ribbon, wherein the metal ribbon includes fragments with metal oxide coating layers formed in spaces between the fragments.

The metal oxide coating layers may be coated on surfaces of the fragments.

The metal oxide coating layer may be an atomic layer deposition layer.

The metal oxide coating layer may include any one of $Al_2O_3$, $TiO_2$, $SiO_2$, $Ta_2O_5$, WO, $Ga_2O_3$, $In_2O_3$, or $ZrO_2$.

The metal ribbon may include an Iron (Fe) based alloy.

The fragments may be distributed in a random manner.

The fragments may include crack portions spaced apart from each other and are regularly arranged.

The crack portions may have a form in which a surface of the metal ribbon is fragmented.

The one or more magnetic layers may include a plurality of layers stacked in a direction.

The metal ribbon may include a Cobalt (Co) based alloy.

The alloy may include Silicon (Si) and Boron (B), a content of Fe in the alloy may be between 70 to 90 atomic percent, and a sum of contents of Si and B in the alloy may be between 10 to 30 atomic percent.

The alloy may include 20 atomic percent or less of any one or any combination of Chromium (Cr) or Cobalt (Co).

The magnetic sheet may include a protective layer formed on one of the one or more magnetic layers, and the protective layer may include any one or any combination of an insulating resin and a polyethylene terephthalate (PET) film.

The protective layer may include a conductive material disposed as a filler.

An adhesive layer may be disposed between any two of the one or more magnetic layers.

The magnetic sheet may include a base layer removably attached to one of the one or more magnetic layers, and the base layer may include any one or any combination of a double-sided tape and a PET film.

In another general aspect, there is provided an electronic device including a coil member, and a magnetic sheet disposed adjacent to the coil member and including one or more magnetic layers formed of a metal ribbon, the metal ribbon including fragments with metal oxide coating layers formed in spaces between the fragments.

The metal oxide coating layers may be coated on surfaces of the fragments.

The metal oxide coating layer may include an atomic layer deposition layer.

The metal oxide coating layer may include any one of $Al_2O_3$, $TiO_2$, $SiO_2$, $Ta_2O_5$, WO, $Ga_2O_3$, $In_2O_3$, or $ZrO_2$.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for the purposes of clarity, illustration, and convenience.

DETAILED DESCRIPTION

Figure 1:
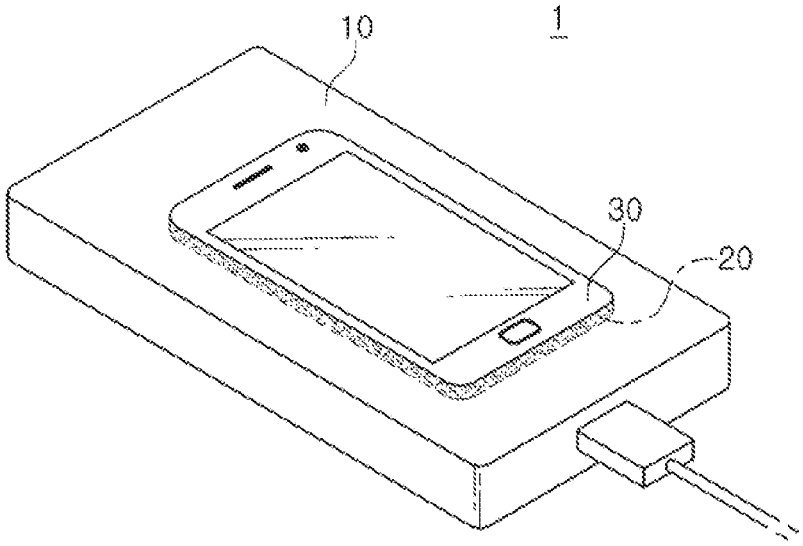
FIG. 1 is a diagram illustrating an example of a wireless charging apparatus.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after gaining a thorough an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

Throughout the specification, when an element, such as a layer, region, or substrate, is described as being "on," "connected to," "coupled to," "over," or "covering" another element, it may be directly "on," "connected to," "coupled to," "over," or "covering" the other element, or there may be one or more other elements intervening therebetween. In contrast, when an element is described as being "directly on," "directly connected to," "directly coupled to," "directly over," or "directly covering" another element, there can be no other elements intervening therebetween.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. As used herein, the term "and/or" includes any one and any combination of any two or more of the associated listed items.

Due to manufacturing techniques and/or tolerances, variations of the shapes shown in the drawings may occur. Thus, the examples described herein are not limited to the specific shapes shown in the drawings, but include changes in shape that occur during manufacturing.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Figure 2:
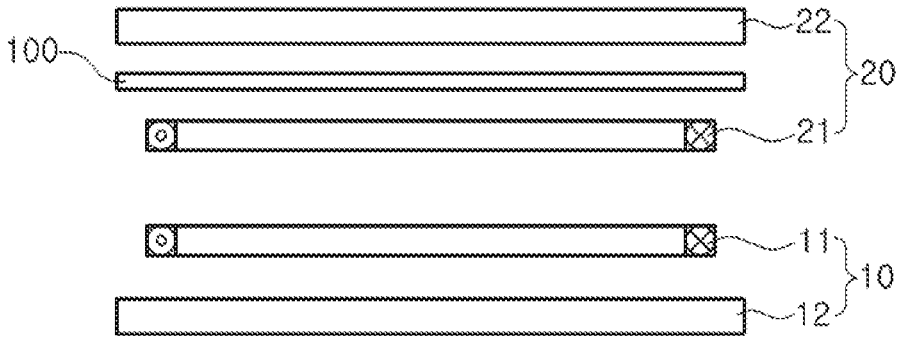
FIG. 2 is a diagram illustrating an example of some internal components of the wireless charging apparatus of FIG. 1.

FIG. 1 is a diagram illustrating an example of a wireless charging apparatus 1, and FIG. 2 is a diagram illustrating an example of some internal components of the wireless charging apparatus of FIG. 1.

Referring to FIGS. 1 and 2, in an example, the general wireless charging apparatus 1 includes a wireless power transmitting apparatus 10 and a wireless power receiving apparatus 20. In an example, and the wireless power receiving apparatus 20 is embodied or incorporated in various types of products 30 such as, for example, an intelligent agent, a mobile phone, a cellular phone, a smart phone, a wearable smart device (such as, a ring, a watch, a pair of glasses, a glasses-type device, a bracelet, an ankle bracelet, a belt, a necklace, an earring, a headband, a helmet, a device embedded in clothing, or an eye glass display (EGD)), a server, a personal computer (PC), a laptop, a notebook, a subnotebook, a netbook, an ultra-mobile personal computer (UMPC), a tablet personal computer (tablet), a phablet, a mobile internet device (MID), a personal digital assistant (PDA), an enterprise digital assistant (EDA), a digital camera, a digital video camera, a portable game console, an MP3 player, a portable/personal multimedia player (PMP), a handheld e-book, a global positioning system (GPS) navigation device, a personal navigation device, a portable navigation device (PND), a handheld game console, a high definition television (HDTV), a smart appliance, communication systems, image processing systems, graphics processing systems, various Internet of Things (IoT) devices that are controlled through a network, a smart vehicle, an intelligent automobile, an autonomous driving vehicle, other consumer electronics/information technology (CE/IT) device, or any other device capable of wireless communication or network communication consistent with that disclosed herein.

In an example, the wireless power transmitting apparatus 10 includes a transmission coil member 11 formed on a substrate 12. When an alternating current (AC) voltage is applied to the wireless power transmitting apparatus 10, a magnetic field is formed in the vicinity of the wireless power transmitting apparatus 10. A battery 22 may be charged by electromotive force induced from the transmission coil member 11 into a reception coil member 21, which is embedded in the wireless power receiving apparatus 20.

In an example, the battery 22 may be a nickel metal hydride battery or a lithium ion battery that is rechargeable. Other batteries are considered to be well within the scope of the present disclosure. In an example, the battery 22 is separate from the wireless power receiving apparatus 20, and is detachable from the wireless power receiving apparatus 20. In another example, the battery 22 is in an integral form where it is configured integrally with the wireless power receiving apparatus 20.

The transmission coil member 11 and the reception coil member 21 may be electromagnetically coupled to each other, may be formed by winding a metal wire formed of material, such as, for example copper. The transmission coil member 11 and the reception coil member 21 may be configured in a variety of shapes, such as, a circular shape, an oval shape, a quadrangular shape, an elliptical shape, a hexagonal shape, and a rhombic shape. In an example, the sizes, the turns of the transmission coil member 11 and the reception coil member 21 may be appropriately controlled and set depending on requirements.

In an example, a magnetic sheet 100 is disposed between the reception coil member 21 and the battery 22. The magnetic sheet 100 may be positioned between the reception coil member 21 and the battery 22 and collect a magnetic flux to allow the magnetic flux to be efficiently received by the reception coil member 21. In an example, the magnetic sheet 100 may serve to block at least some of the magnetic flux from arriving at the battery 22.

Such a magnetic sheet 100 may be coupled to a coil member in the reception part or the transmission part of the wireless charging apparatus described above. The magnetic sheet 100 may also be used in Magnetic Secure Transmission (MST), Near Field Communication (NFC), or the like, in addition to the wireless charging apparatus. The magnetic sheet 100 may be used in a transmission part of the wireless charging apparatus rather than the reception part of the wireless charging apparatus, and both of the transmission coil member and the reception coil member will hereinafter be referred to as coil members when they do not need to be distinguished from each other. The magnetic sheet 100 will be described in more detail.

Figure 3:
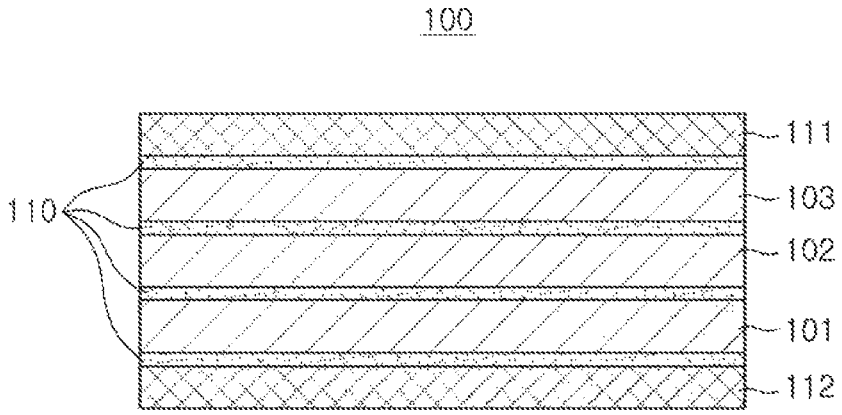
FIG. 3 is a diagram illustrating an example of a magnetic sheet.
Figure 4:
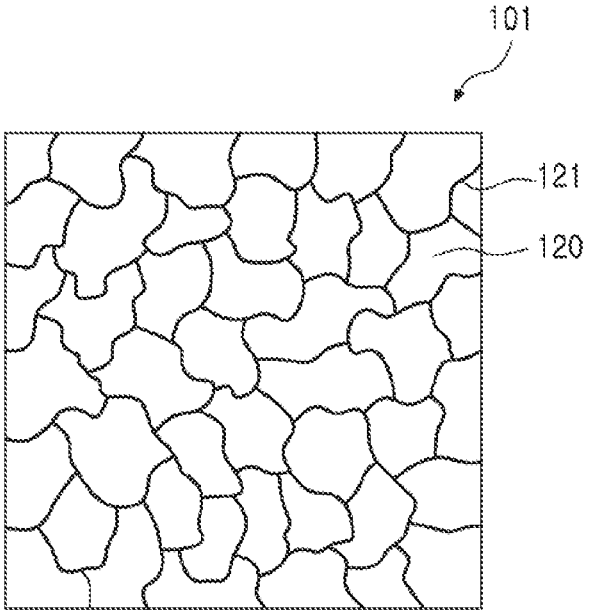
FIGS. 4 through 6 are diagrams illustrating examples of fragment structures of a magnetic layer that may be used in the magnetic sheet of FIG. 3.
Figure 5:
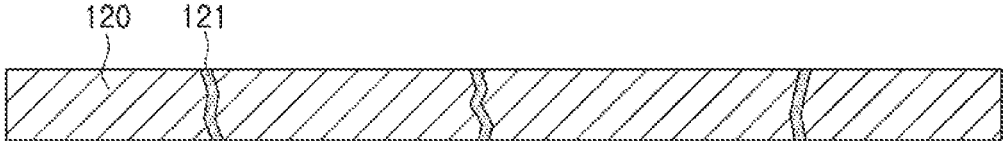
Figure 6:
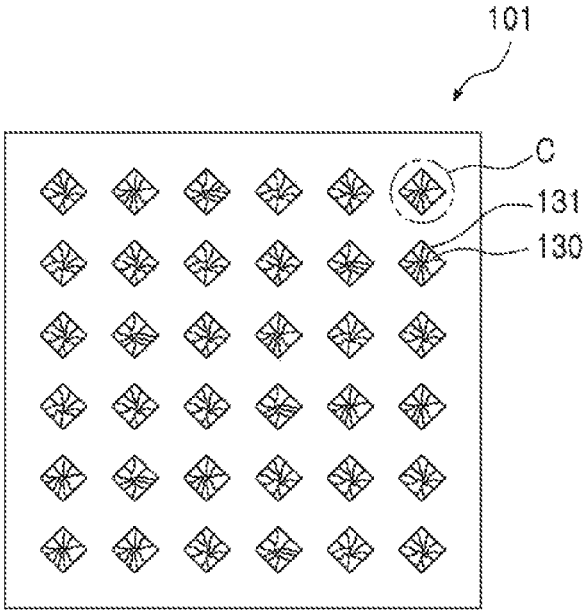

FIG. 3 is a diagram illustrating an example of a magnetic sheet. FIGS. 4 through 6 are diagrams illustrating fragment structures of a magnetic layer that may be used in the magnetic sheet of FIG. 3.

The magnetic sheet 100 may include a plurality of magnetic layers 101 to 103 formed of a metal ribbon, and in an example of FIG. 3, three magnetic layers 101 to 103 are included in the magnetic sheet 100. A number of magnetic layers 101 to 103 may be varied depending on requirements, such as, required shielding characteristics, and a thickness of the magnetic sheet 100. In another example, the magnetic sheet 100 includes a single magnetic layer.

To implement a stable multilayer structure, adhesive layers 110 are interposed between the plurality of magnetic layers 101 to 103. In an example, a protective layer 111 is formed on one surface of a multilayer structure formed by the plurality of magnetic layers 101 to 103, and a base layer 112 is formed on the other surface of the multilayer structure. However, in an example, the adhesive layers 110, the protective layer 111, and the base layer 112 may be excluded or replaced by other components in some cases.

In an example, a thin metal ribbon formed of a material such as, for example, an amorphous alloy or a nanocrystalline alloy is used as a material of each of the magnetic layers 101 to 103 for collecting and shielding electromagnetic waves. In an example, the amorphous alloy is an Iron (Fe) based or Cobalt (Co) based magnetic alloy. A material including Silicon (Si), for example, a Fe—Si—B alloy may be used as the Fe based magnetic alloy, and as a content of metal including Fe in the Fe—Si—B alloy becomes high, a saturation magnetic flux density becomes high. However, when a content of Fe is excessive, it is difficult to form an amorphous alloy. Therefore, in an example, a content of Fe is 70 to 90 atomic percent, and it may be most appropriate in terms of capability to form an amorphous alloy that the sum of contents of Si and B is in a range of 10 to 30 atomic percent. In an example, 20 atomic percent or less of a corrosion resistant element such as, for example, Chromium (Cr) or Co is added to such a basic composition to prevent corrosion. In an example, a small amount of other metal elements may be added to provide other characteristics, as needed.

In another example, when the nanocrystalline alloy is used as the material of each of the magnetic layers 101 to 103, for example, an Iron based nanocrystalline magnetic alloy may be used. In an example, a Fe—Si—B—Cu—Nb alloy is used as the Iron based nanocrystalline magnetic alloy. In an example, the nanocrystalline alloy is obtained by performing a magnetic field heat-treatment, a non-magnetic field heat-treatment, a stress heat-treatment, or the like, on the Iron based amorphous alloy described above.

In the present example, any one or more of the magnetic layers 101 to 103 may have a structure in which the metal ribbon constituting the magnetic layer is fragmented into a plurality of fragments. In an example, metal oxide coating layers are formed in spaces between the plurality of fragments to enhance an insulating property between the fragments of the metal ribbon. This will be further described in relation to a single magnetic layer 101 of the plurality of magnetic layers 101 to 103 with reference to FIGS. 4 through 6. However, fragment structures of a metal ribbon and metal oxide coating layers that are described below are also applicable to other magnetic layers, such as, magnetic layers 102 and 103.

As illustrated in FIGS. 4 and 5, the magnetic layer 101 has a structure in which the metal ribbon is fragmented into the plurality of fragments 120, and may include metal oxide coating layers 121 formed in spaces between the plurality of fragments 120. The metal oxide coating layers 121 may be coated on surfaces of the plurality of fragments 120. The metal oxide coating layers 121 enable the plurality of fragments 120 having high electrical conductivity to be electrically insulated from each other to thus reduce eddy current loss that may be generated in the magnetic layer 101. In addition, frequency characteristics and a Q value of the magnetic layer 101 may be improved due to the reduction in the eddy current loss of the magnetic layer 101. Since the magnetic sheet 100 may be effectively operated at a high frequency due to the improvement of the frequency characteristics and the Q value, the magnetic sheet 100 may be widely used in various wireless power transmitting and receiving apparatuses. For example, the magnetic sheet 100 may be applied to an Alliance for Wireless Power (A4WP) scheme using a frequency band of several MHz as well as Wireless Power Consortium (WPC) and Power Matters Alliance (PMA) schemes using a frequency band of several hundreds of kHz.

As described above, the metal oxide coating layers 121 provide enhanced insulating properties to the fragments 120 of the metal ribbon, and implement effective and uniform insulating properties in the entire region of the magnetic layer 101 as compared to an insulating structure formed of a material such as a polymer. In the insulating structure formed of the polymer, insulating thicknesses may be different from each other in each region, such that insulation performance may not be sufficient, but the metal oxide coating layers 121 may be appropriate to be coated at a uniform thickness in regions between the fragments 121 in terms of a material constituting the metal oxide coating layers 121 or a coating process.

An example in which the metal oxide coating layers 121 are formed in all of the spaces between the plurality of fragments 120 is illustrated in FIGS. 4 and 5. However, other examples in which the metal oxide coating layers 121 are not formed in some of the spaces between the plurality of fragments 120, and pores are considered to be well within the scope of the present disclosure.

In an example, the metal oxide coating layer 121 is formed of a metal oxide that may be coated in the space between the fragments 120, and some example of such a metal oxide include $Al_2O_3$, $TiO_2$, $SiO_2$, $Ta_2O_5$, WO, $Ga_2O_3$, $In_2O_3$, or $ZrO_2$. In an example, any one or any combination of methods such as, for example, atomic layer deposition (ALD), chemical vapor deposition (CVD), or a wet process is used to form the metal oxide coating layer 121. When the metal oxide coating layer 121 is implemented in a form of an atomic layer deposition layer or a chemical vapor deposition layer, a dense film structure having excellent insulating properties may be obtained. In another example, when the metal oxide coating layer 121 is formed using the wet process, the metal oxide coating layer 121 may have a form in which particles are attached to the surfaces of the fragments 120.

When the metal oxide coating layer 121 having a thin film form is formed using the atomic layer deposition, a coating property on the surfaces of the fragments 120 may be excellent, such that it may be easy to finely adjust a coating thickness.

In an example, the fragment structures of the metal ribbon may be randomly formed as in an example in FIGS. 4 and 5, but may be provided in a form of crack portions C in which a surface of the magnetic layer 101 is fragmented as illustrated in FIG. 6. In addition, as in the example described above, metal oxide coating layers 131 may be formed in spaces between fragments 130 constituting the crack portions C to form an insulating structure. A magnetic permeability of the magnetic layer 101 may be adjusted using the crack portions C that are regular fragmented structures, and a change in the magnetic permeability may be generated by making fragmented levels in each region of the magnetic layer 101 different from each other. In an example, a plurality of crack portions C may be arranged in regular shapes and intervals.

As illustrated in FIG. 3, the protective layer 111 is formed on at least one surface of the plurality of magnetic layers 101 to 103, and protects the magnetic layers 101 to 103 from an external influence. When the magnetic layers 101 to 103 are formed of the Iron alloy, or the like, and are externally exposed, the magnetic layers 101 to 103 may be vulnerable to environmental conditions such as, moisture or salt, and, characteristics of the magnetic layers 101 to 103 may deteriorate because of the external influence. In an example, the protective layer 111 prevents the deterioration of the characteristics of the magnetic layers 101 to 103. In an example, a material of the protective layer may include an insulating resin such as epoxy, a polyethylene terephthalate (PET) film, or the like.

In an example, the protective layer 111 may perform a heat dissipation function, in addition to the protecting function. To this end, the protective layer 111 may include a high heat dissipation filler, i.e., a conductive material such as, for example, carbon, copper, or iron. As described above, the protective layer 111 may have high thermal conductivity, and heat generated by the magnetic layers 101 to 103 may be effectively dissipated. Since the protective layer has thermal conductivity higher than that of air, heat accumulated in the magnetic layers 101 to 103 may be effectively dissipated. Therefore, reliability of an electronic device using the protective layer may be improved.

In an example, the adhesive layers 110 interposed between the plurality of magnetic layers 101 to 103 may be provided for the purpose of interlayer bonding, as well as interlayer insulation, between the magnetic layers 101 to 103. Any material may be used as a material of each of the adhesive layers 110 as long as it is appropriate for bonding the magnetic layers 101 to 103 to each other. In an example, double-sided tape may be used.

In an example, the base layer 112 protects the magnetic layers 101 to 103, and the magnetic layers 101 to 103 are more easily handled by the base layer 112. In an example, the base layer 112 is a film such as a PET film, and is provided in a form of a double-sided tape to be bonded to a coil component, or the like. In an example, an adhesive material is formed on a lower surface of the base layer 112. In another example, the base layer 112 serves as a release film at the time of being applied to the coil component, or the like. In an example, the base layer 112 is separated from the magnetic layers 101 to 103, the protective layer 111, and only the magnetic layers 101 to 103, and the protective layer 111 is bonded to the coil component.

Figure 7:
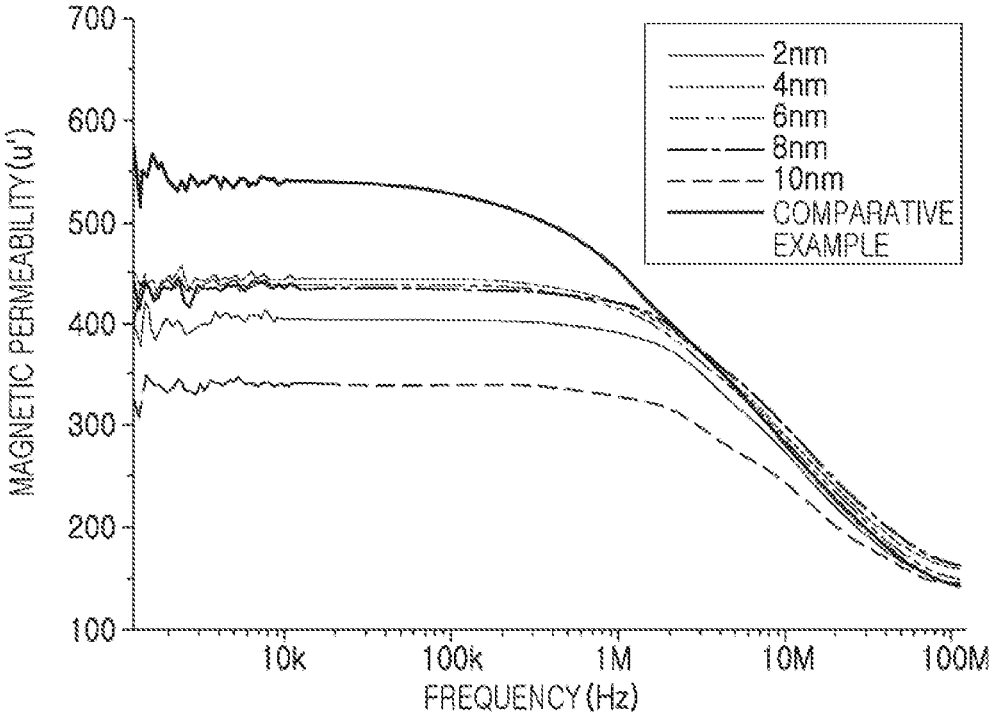
FIG. 7 is diagram illustrating examples of changes in frequency characteristics of magnetic permeabilities according to thicknesses of metal oxide coating layers.
Figure 8:
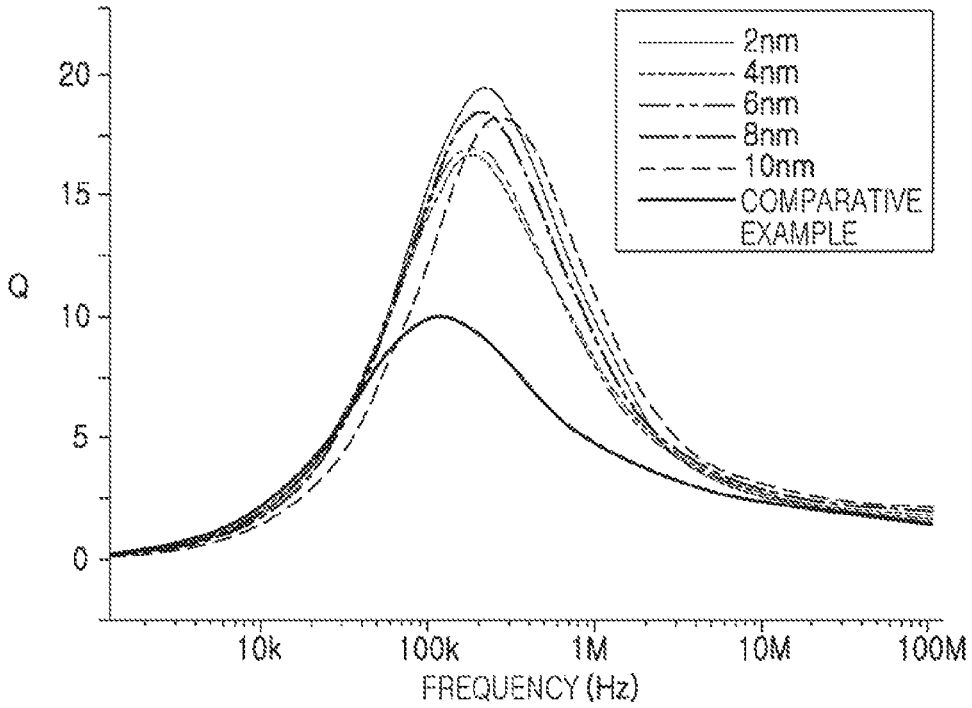
FIG. 8 is diagram illustrating examples of changes in frequency characteristics of Q values according to thicknesses of metal oxide coating layers.

Frequency and Q value characteristics according to Inventive Example (in which metal oxide coating layers are used) and Comparative Example (in which metal oxide coating layers are not used) will be described with reference to FIGS. 7 and 8. FIG. 7 is graphs illustrating changes in frequency characteristics of magnetic permeabilities according to thicknesses of metal oxide coating layers. FIG. 8 is graphs illustrating changes in frequency characteristics of Q values according to thicknesses of metal oxide coating layers.

In an example, metal oxide coating layers ($Al_2O_3$) are formed in spaces between fragments of a metal ribbon using an ALD method while changing thicknesses of the metal oxide coating layers, and a sheet formed of a plurality of fragments without the metal oxide coating layers as a Comparative Example. As shown in FIG. 7, frequency characteristics of a magnetic permeability are improved by 1 MHz or more in a metal ribbon sheet to which the metal oxide coating layers are applied as compared to the Comparative Example. In addition, when the metal oxide coating layers are used, an absolute value of a maximum value (Qmax) of Q value characteristics is increased and frequency characteristics of the Q value characteristics are also improved. Thus, a wireless charging apparatus that may be operated in a high frequency region may be implemented using a nanocrystalline metal ribbon that was difficult to use for wireless charging in a magnetic resonance scheme. The magnetic sheet including the metal oxide coating layers and the fragment structure is able to maintain a low magnetic permeability without having a large change in characteristics even at a high frequency. Therefore, the magnetic sheet including the metal oxide coating layers and the fragment structure may be effectively applied to a wireless charging apparatus using a high frequency band.

As set forth above, the magnetic sheet according to the example in the present disclosure may be used in a wide frequency band to be thus applied to various wireless power transmitting and receiving schemes. For example, the magnetic sheet may be applied to both of the WPC and PMA schemes using a frequency band of several hundreds of kHz and the A4WP scheme using a frequency band of several MHz.

As set forth above, a magnetic sheet capable of being used in wide frequency band can be applied to various wireless power transmitting and receiving schemes, and an electronic device including the same.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A magnetic sheet comprising:

one or more magnetic layers each comprising a metal ribbon broken into fragments, and metal oxide coating layers disposed in spaces between the fragments, wherein the metal ribbon comprises an amorphous alloy or a nanocrystalline alloy, the one or more magnetic layers are a plurality of magnetic layers, the magnetic sheet further comprises an adhesive layer disposed between two adjacent magnetic layers of the plurality of magnetic layers, a material of the adhesive layer is different from a material of the metal oxide coating layers, and opposing surfaces of adjacent fragments among the fragments have respective shapes that substantially match each other over substantially an entire area of each of the opposing surfaces.

2. The magnetic sheet of claim 1, wherein the metal oxide coating layers are disposed on surfaces of the fragments.

3. The magnetic sheet of claim 1, wherein each of the metal oxide coating layers is an atomic layer deposition layer.

4. The magnetic sheet of claim 1, wherein the metal oxide coating layers comprise any one of $Al_2O_3$, $TiO_2$, $SiO_2$, $Ta_2O_5$, WO, $Ga_2O_3$, $In_2O_3$, and $ZrO_2$.

5. The magnetic sheet of claim 1, wherein the amorphous alloy or the nanocrystalline alloy is an iron (Fe) based alloy.

6. The magnetic sheet of claim 5, wherein the iron (Fe) based alloy comprises iron (Fe), silicon (Si) and boron (B), a content of Fe in the iron (Fe) based alloy is between 70 to 90 atomic percent, and a sum of contents of Si and B in the iron (Fe) based alloy is between 10 to 30 atomic percent.

7. The magnetic sheet of claim 6, wherein the iron (Fe) based alloy further comprises a total of 20 atomic percent or less of either one or both of chromium (Cr) and cobalt (Co).

8. The magnetic sheet of claim 1, wherein the fragments have random shapes.

9. The magnetic sheet of claim 1, wherein the metal ribbon comprises crack portions spaced apart from each other in a regular arrangement, and the fragments are disposed in the crack portions.

10. The magnetic sheet of claim 9, wherein the crack portions are portions of the metal ribbon in which a surface of the metal ribbon is broken into the fragments, and are separated from each other by portions of the metal ribbon in which the surface of the metal ribbon is not broken into fragments.

11. The magnetic sheet of claim 1, wherein the plurality of magnetic layers are stacked one on top of another.

12. The magnetic sheet of claim 1, wherein the amorphous alloy or the nanocrystalline alloy is a cobalt (Co) based alloy.

13. The magnetic sheet of claim 1, further comprising a protective layer disposed on an external surface of the plurality of magnetic layers, wherein the protective layer comprises either one or both of an epoxy and a polyethylene terephthalate (PET) film.

14. The magnetic sheet of claim 13, wherein the protective layer further comprises a conductive material constituting a heat dissipation filler.

15. The magnetic sheet of claim 1, further comprising a base layer removably attached to an external surface of the plurality of magnetic layers, wherein the base layer comprises either one or both of a double-sided tape and a polyethylene terephthalate (PET) film.

16. The magnetic sheet of claim 1, wherein the fragments have irregular shapes, and a thickness of each of the fragments is equal to a thickness of every other one of the fragments.

17. An electronic device comprising:

a coil member; and a magnetic sheet disposed adjacent to the coil member and comprising one or more magnetic layers each comprising a metal ribbon broken into fragments, and metal oxide coating layers disposed in spaces between the fragments, wherein the metal ribbon comprises an amorphous alloy or a nanocrystalline alloy, the one or more magnetic layers are a plurality of magnetic layers, the magnetic sheet further comprises an adhesive layer disposed between two adjacent magnetic layers of the plurality of magnetic layers, a material of the adhesive layer is different from a material of the metal oxide coating layers, and opposing surfaces of adjacent fragments among the fragments have respective shapes that substantially match each other over substantially an entire area of each of the opposing surfaces.

18. The electronic device of claim 17, wherein the metal oxide coating layers are coated on surfaces of the fragments.

19. The electronic device of claim 17, wherein each of the metal oxide coating layers is an atomic layer deposition layer.

20. The electronic device of claim 17, wherein the metal oxide coating layers comprise any one of $Al_2O_3$, $TiO_2$, $SiO_2$, $Ta_2O_5$, WO, $Ga_2O_3$, $In_2O_3$, and $ZrO_2$.

21. The electronic device of claim 17, wherein the fragments have irregular shapes, and a thickness of each of the fragments is equal to a thickness of every other one of the fragments.

* * * * *